US007554500B1

(12) United States Patent
Sergi

(10) Patent No.: US 7,554,500 B1
(45) Date of Patent: Jun. 30, 2009

(54) TUNING CIRCUIT FOR A TRAP ANTENNA

(76) Inventor: Paul D. Sergi, 2570 Major Rd., Peninsula, OH (US) 44264

( * ) Notice: Subject to any disclaimer, the term of this patent is extended or adjusted under 35 U.S.C. 154(b) by 0 days.

(21) Appl. No.: 12/079,534

(22) Filed: Mar. 27, 2008

Related U.S. Application Data

(60) Provisional application No. 60/921,302, filed on Apr. 2, 2007.

(51) Int. Cl.
*H01Q 9/14* (2006.01)

(52) U.S. Cl. ..... 343/722; 343/745; 343/749

(58) Field of Classification Search ..... 343/722, 343/745, 749, 750
See application file for complete search history.

(56) References Cited

U.S. PATENT DOCUMENTS 2,106,776 A * 2/1938 Bertram et al. ..... 455/281
4,259,672 A * 3/1981 Newcomb ..... 343/722
4,334,228 A * 6/1982 Johns ..... 343/722
4,890,116 A * 12/1989 Lewis, Jr. ..... 343/749

* cited by examiner

*Primary Examiner*—Tho G Phan
(74) *Attorney, Agent, or Firm*—Renner, Kenner, Greive, Bobak, Taylor & Weber

(57) ABSTRACT

The present tuning circuit for a trap antenna having a plurality of traps tuned to a predetermined frequency comprises a coil in which a conductive compensation section is electrically coupled to one end of the coil and a conductive tuning section is electrically coupled to the other end of the coil. A pair of rods electrically coupled to the tuning section extend in opposite directions therefrom, whereby the adjustment of the rods and the coil allow the tuning circuit to be operable at a desired resonant frequency. To prevent the detuning of the trap to which the tuning circuit is being attached, the dimension of the compensation section may be adjusted to enable the trap antenna to be operable at both its predetermined frequency and the desired resonant frequency established by the tuning circuit.

14 Claims, 4 Drawing Sheets

TUNING CIRCUIT FOR A TRAP ANTENNA

CROSS-REFERENCE TO RELATED APPLICATION

This application claims the benefit of U.S. Provisional Application No. 60/921,302, filed Apr. 2, 2007. The specification of the above-referenced application is incorporated herein by reference.

TECHNICAL FIELD

The present invention relates to a tuning circuit for an antenna. More particularly, the present invention relates to a tuning circuit for a trap antenna. Specifically, the present invention relates to a tuning circuit that can be selectively attached to a trap antenna so as to add a new operating frequency, without affecting the resonance of the trap and the antenna to which the tuning circuit is attached.

BACKGROUND OF THE INVENTION

A trap or trapped antenna is configured to be resonant at multiple frequencies. To achieve this mode of operation, the trap antenna contains a number of electrically isolated sections, which are separated by multiple traps. Each of the traps includes a parallel resonant circuit that is tuned to a different resonant or operating frequency. Because the parallel resonant circuit of each of the traps is tuned to a different resonant frequency, the trap antenna is able to exhibit the correct feed-point impedance when transmitting and receiving communication signals at those various resonant frequencies.

Due to their design, trap antennas are unable to be easily tuned to receive or transmit new or additional radio communication frequencies that have come into use after the manufacture of the trap antenna. In fact, in order to retune the trap antenna to work acceptably with a new or additional communication frequency, an additional trap would have to be inserted between the existing traps of the trap antenna. Such a modification would require the redesign of the circuitry of the original traps so that they continue operating at their original resonant frequencies.

Traditional methods of adding frequencies to non-trapped antennas involve adding an additional coil and conductive section at a particular point on the original antenna that resonates at the desired frequency and provides the correct impedance at the feed-point of the antenna at the additional resonant frequency. However, utilizing such a technique with an antenna containing traps alters the resonant frequency established by the parallel tuned circuit of the trap to which the tuning circuit is attached, which is unwanted.

Thus, there is a need for a tuning circuit for a trap antenna that may be easily attached to an existing trap antenna. Moreover, there is a need for a tuning circuit for a trap antenna that enables an existing trap antenna to operate at a new operating frequency without affecting the resonant frequency of the trap and the antenna to which the tuning circuit is attached.

DISCLOSURE OF THE INVENTION

It is thus an object of the present invention to provide a tuning circuit for a trap antenna that utilizes a compensation section to counter the amount of inductive reactance contributed by the coil of the tuning circuit when the tuning circuit is used with traps tuned to a frequency greater than the resonant frequency of the tuning circuit.

It is another object of the present invention to provide a tuning circuit for a trap antenna that uses the variability of the distance between adjacent traps to increase inductive reactance to counter the amount of capacitive reactance contributed by the rods of the tuning circuit when the tuning circuit is used with an antenna containing traps that is tuned to a frequency less than the resonant frequency of the tuning circuit.

It is still another object of the present invention to provide a tuning circuit for a trap antenna that is easily mounted to an antenna containing traps.

These and other objects of the present invention, as well as the advantages thereof over existing prior art forms, which will become apparent from the description to follow, are accomplished by the improvements hereinafter described and claimed.

In general, a tuning circuit for a trap antenna having at least one trap with an electrically-conductive surface includes an electrically-conductive coil having a first end and a second end. An electrically-conductive compensation section is coupled to the first end of the coil, and the compensation section is adapted to be electrically coupled to the conductive surface of the trap. A pair of electrically-conductive rods are connected to the second end of the coil.

In accordance with another aspect of the present invention, a method for tuning a trap antenna having at least one trap tuned to a predetermined frequency, the traps having an electrically-conductive surface, includes the steps of providing a tuning circuit having an electrically-conductive coil coupled at one end to an electrically-conductive compensation section and at another end, to a pair of electrically-conductive rods. The method also includes the steps of attaching the compensation section to the at least one trap, adjusting the coil and the rods to tune the tuning circuit to a desired resonant frequency, and adjusting the dimension of the compensation section to establish an amount of capacitive reactance that substantially equals the amount of inductive reactance of the coil if the resonant frequency of the tuning circuit is below the predetermined frequency of the trap to thereby enable the trap antenna to be operable at the predetermined frequency and the desired resonant frequency.

A preferred exemplary tuning circuit for a trap antenna incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
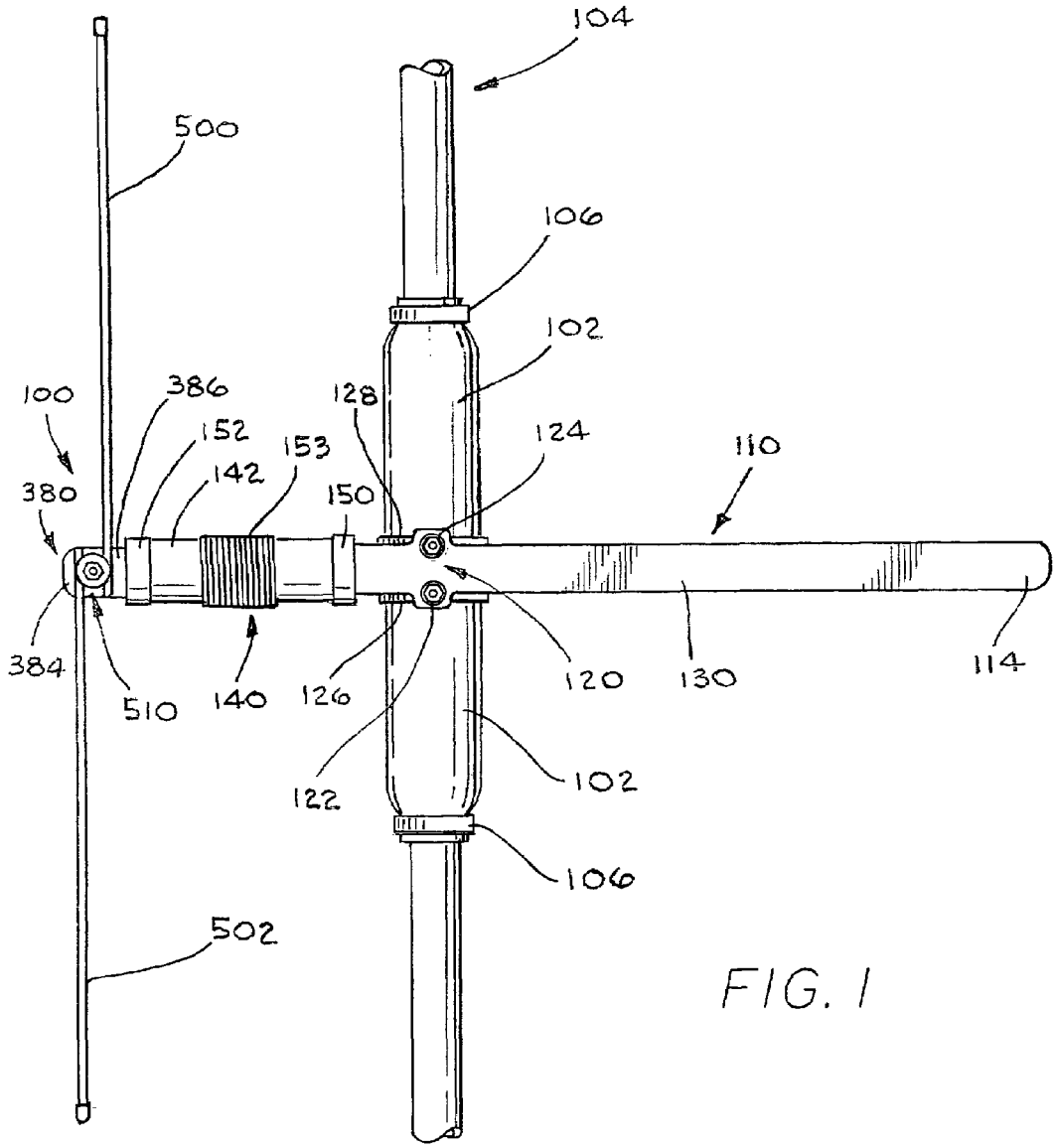
FIG. 1 is a somewhat schematic elevational view of a tuning circuit for a trap antenna according to the concepts of the present invention.
Figure 2:
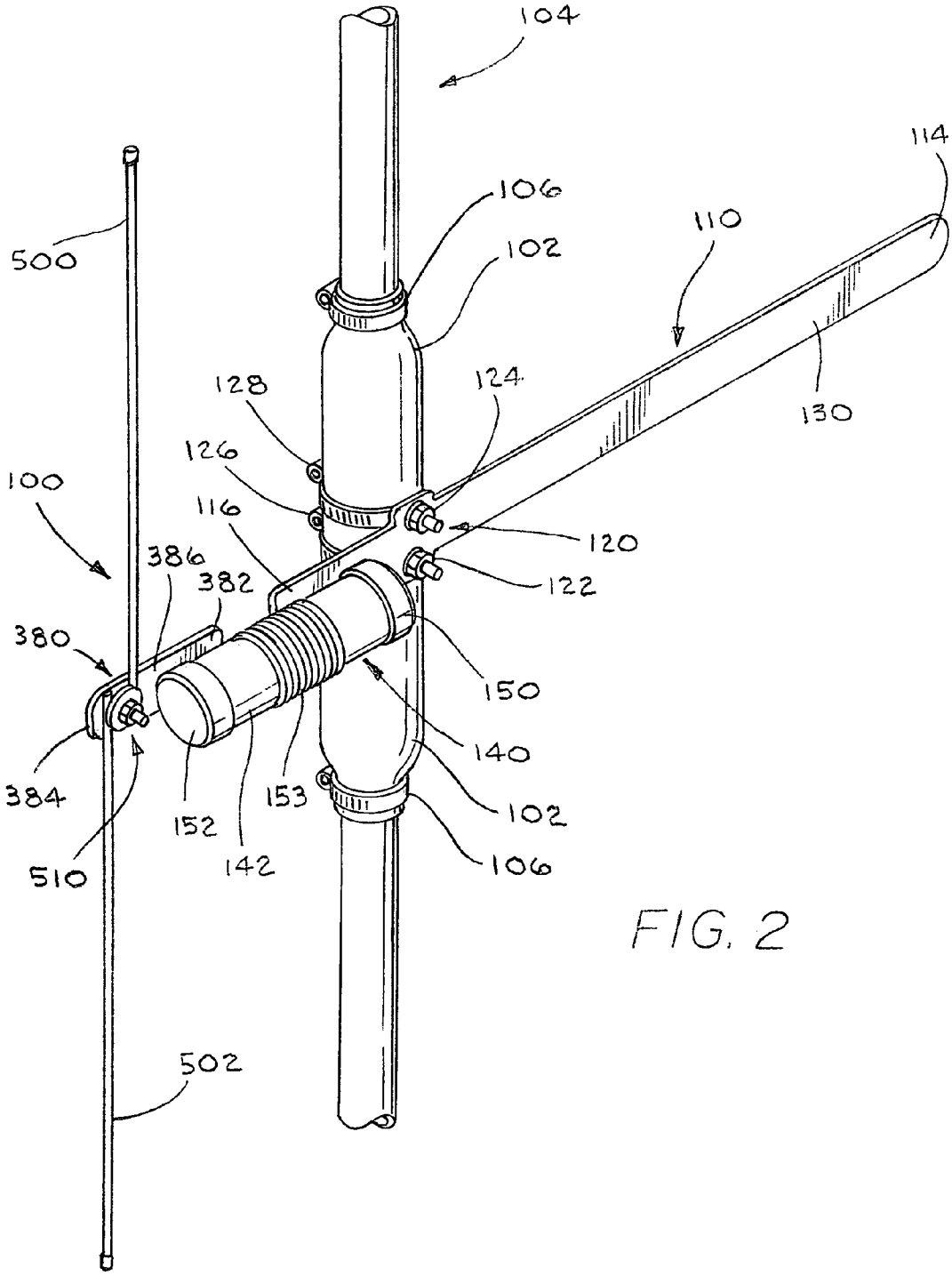
FIG. 2 is a somewhat schematic perspective view of the tuning circuit for the trap antenna according to the concepts of the present invention.

A tuning circuit for a trap antenna is generally indicated by the numeral 100 in the drawings. Tuning circuit 100 is configured to be removably mounted to a particular trap 102 maintained by trap antenna 104. Each trap 102 includes a parallel resonant circuit (not shown) tuned to a predetermined resonant frequency that enables trap antenna 104 to transmit and receive signals at frequencies corresponding thereto. In addition, trap antenna 104 may contain several traps 102 that correspond to particular frequencies that antenna 104 is able to transmit and/or receive. That is, while the antenna 104 shown in the drawings includes only one trap 102, such should not be limiting as other traps tuned to various operating frequencies may be maintained by the antenna 104 as well. In addition, the trap 102 is attached to the trap antenna 104 so that it can be adjustably positioned along the length of the antenna 104, and fastened thereto by clamps 106, or other suitable fasteners, whereupon the trap 102 and antenna 104 are electrically coupled. Tuning circuit 100 is formed as a series resonant circuit and is configured such that when tuning circuit 100 is mounted to a desired trap 102, trap antenna 104 is able to transmit and receive signals corresponding to a new resonant frequency established by tuning circuit 100. In other words, tuning circuit 100 enables an existing trap antenna 104 to transmit and receive signals having a new frequency established by tuning circuit 100, without affecting the resonance of the trap 102 and the antenna 104 to which the tuning circuit 100 is attached.

Tuning circuit 100 includes an elongated compensation section 110 that has opposed ends 114 and 116. Compensation section 110 is formed from electrically-conductive material, such as copper, steel, aluminum or other like material. Disposed between ends 114 and 116, and proximate to end 116, is a mounting region 120 that includes a pair of vertically-spaced apertures (not shown) that are configured to receive suitable fasteners 122, 124 such as a bolt and nut, which mount the compensation section 110 via clamps 126 and 128 onto trap 102. In addition, compensation section 110 is of a rectangular cross-section, having opposing surfaces 130, 132 the area of which establishes a level of capacitance (C), as will be hereinafter discussed. As previously described, clamps 126 and 128 are configured to be mounted about trap 102, thus allowing tuning circuit 100 to be mounted to trap antenna 104, while ensuring an electrical coupling between compensation section 110 and the outer conductive surface of trap 102. Between end 116 of compensation section 110 and mounting region 120 resides a pair of horizontally-spaced apertures (not shown) that are utilized for carrying a coil, generally indicated by the numeral 140, such as an inductor.

Coil 140 includes a core 142 terminated at each end by end caps 150 and 152. The core 142 may be formed from any suitable material, such as plastic for example. Wrapped about core 142 is an electrically-conductive winding 153 terminated at each end by winding connectors 160 and 162. Within the interior portion 164 of the core 142 reside a pair of metal shunts 170 and 172, shown in FIG. 3, that are respectively associated with winding connectors 160 and 162. It should be appreciated that the shunts 170 and 172 may be formed from any desired conductive material. The metal shunts 170, 172 include respective shunt apertures 180 and 182 that are aligned with respective core apertures 190 and 192 maintained by the core 142. Each of the winding connectors 160 and 162 are electrically coupled to the respective metal shunts 170, 172 by any suitable fasteners, such as bolts 200 and 202, that are received through respective shunt apertures 180, 182, and respective core apertures 190, 192. The bolts 200, 202 are held in place by respective nuts 210 and 212. In addition, spacing assemblies 220 and 222 may be disposed between the outer surface 214 of the core 142 and the respective winding connectors 160 and 162. The spacing assemblies 220, 222 may include any combination of spacers 230, 232, flat washers 240, 242, or star washers 250, 252. In particular, the spacers 230, 232 may be comprised of rubber o-rings or any other material that forms an at least water resistant seal about the core apertures 190, 192 when compressed by the washers 240, 242, 250, 252. It should also be appreciated that the flat washers 240, 242 and the star washers 250, 252 may be replaced with any suitable washer desired.

To prevent the accumulation of precipitation, such as water and snow, on winding 153, a cover (not shown) may be utilized. The cover may include a section of foam that is dimensioned to encapsulate the winding 153. In addition, each end of the core 142 may include an o-ring, formed from silicone or rubber for example, each of which is positioned proximate to each side of the foam section. To complete the cover, heat shrinkable tubing or other water resistant material is then disposed over the foam section and the o-rings, such that a compressive force about the circumference of the o-rings forms an at least water resistant seal about the winding 153.

Figure 3:
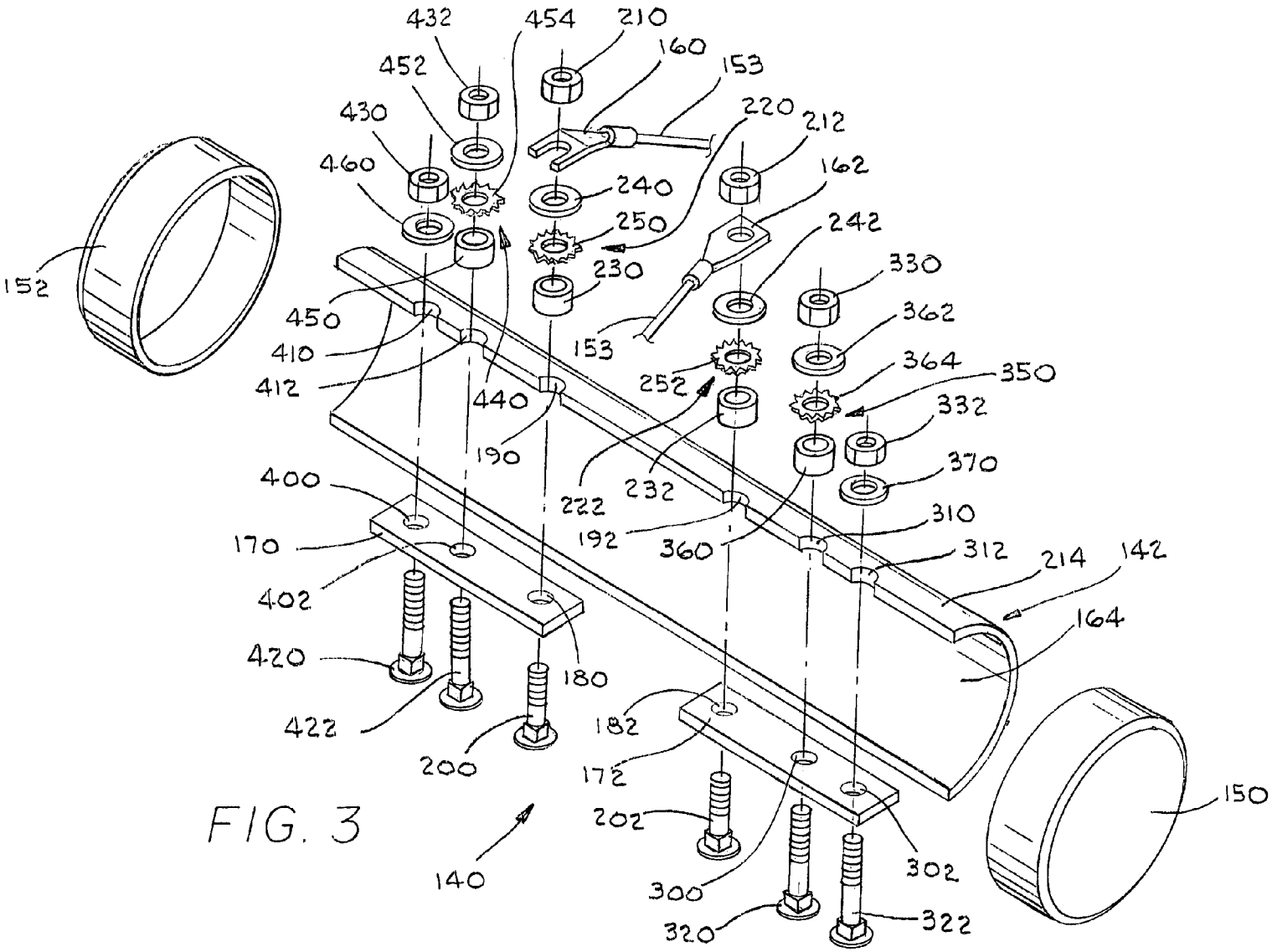
FIG. 3 is an exploded view of a coil for the tuning circuit for the trap antenna according to the concepts of the present invention.

As shown in FIG. 3, to provide electrical connection terminals for attaching the coil 140 to the compensation section 110, the metal shunt 172 of the coil 140 includes shunt apertures 300 and 302 that are aligned with core apertures 310 and 312 maintained by the core 142. In addition, a pair of suitable fasteners, such as a pair of bolts 320, 322, are received through respective shunt apertures 300, 302, and respective core apertures 310, 312. Bolts 320, 322 are held in place by respective nuts 330 and 332. With regard to bolt 320, a spacing assembly 350 may be disposed between the outer surface 214 of the core 142 and the nut 330. The spacing assembly 350 may include any combination of a spacer 360, a flat washer 362, and a star washer 364. In particular, the spacer 360 may be comprised of a rubber o-ring or any other material that forms an at least water resistant seal about the core aperture 310 when compressed by the washers 362, 364. It should also be appreciated that the flat washer 362 and the star washer 364 may be replaced with any other suitable washer. With regard to bolt 322, a washer 370 may be disposed between the outer surface 214 of the core 142 and the nut 332. The portion of the bolts 320 and 322 that extend through the core apertures 310 and 312 forms connection terminals 372 and 374, shown in FIGS. 4 and 5, that are received by the horizontally-spaced apertures at the end 116 of the compensation section 110. Fasteners, such as nuts 376 and 378, are disposed upon the respective connection terminals 350 and 352 to hold the compensation section 110 in place. It should also be appreciated that the length dimension of the bolts 320, 322 are selected so that the connection terminals 372 and 374 have a sufficient length to be received by the horizontally-spaced apertures of the compensation section 110. Thus, through the connection described, the compensation section 110 is electrically coupled to the winding 153 of the coil 140 via connection terminals 372, 374 and the shunt 172.

The tuning circuit 100 also includes a tuning section 380 having ends 382 and 384, and surfaces 386 and 388. Tuning section 380 is generally of a rectangular cross section made of an electrically-conductive material, such as copper, steel, aluminum or other like material. Tuning section 380 has a length dimension that is generally shorter than that of compensation section 110. In addition, end 382 includes a pair of horizontally-spaced apertures (not shown), while end 384 of tuning section 380 includes a single aperture (not shown).

Figure 4:
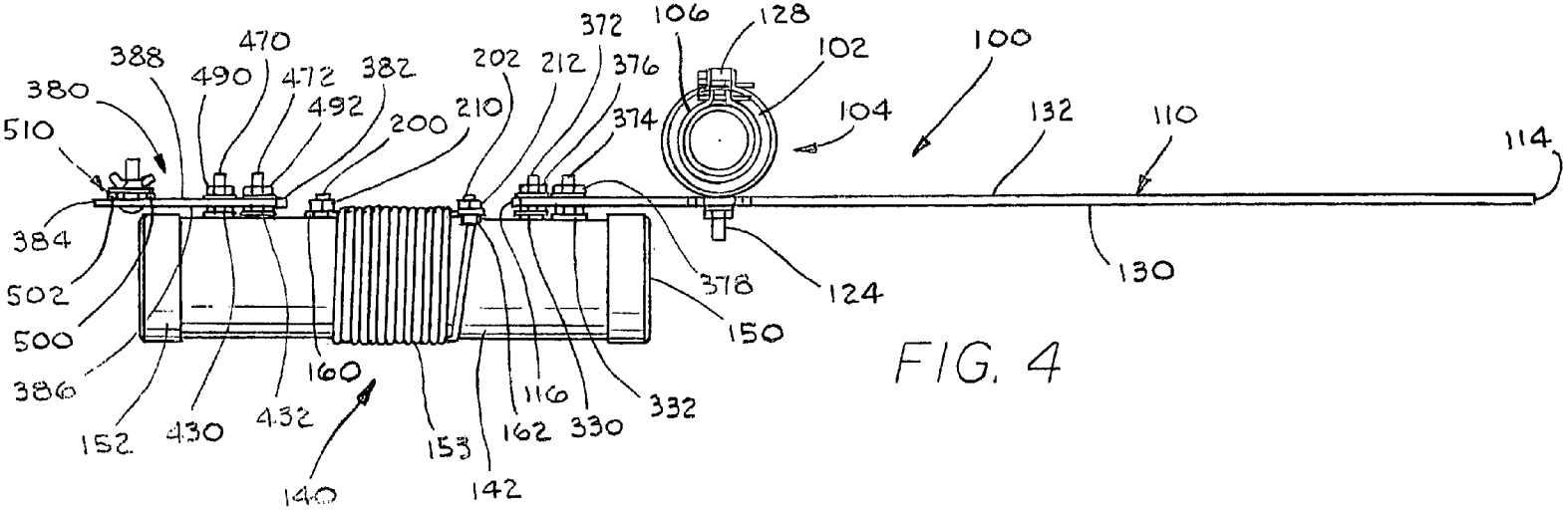
FIG. 4 is a somewhat schematic top plan view of the tuning circuit for the trap antenna according to the concepts of the present invention.
Figure 5:
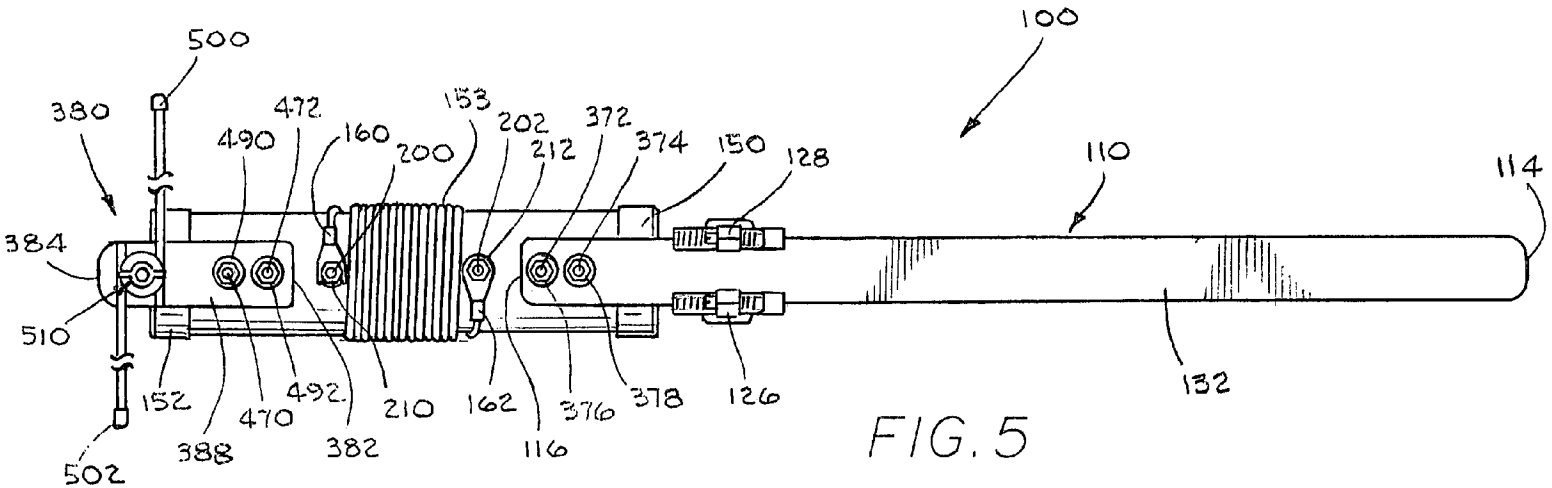
FIG. 5 is a rear elevational view of the tuning circuit for the trap antenna according to the concepts of the present invention.

To provide electrical connection terminals for attaching the coil 140 to the tuning section 380, the metal shunt 170 of the coil 140 includes shunt apertures 400 and 402, that are respectively aligned with core apertures 410 and 412 maintained by the core 142, as shown in FIG. 3. In addition, a pair of suitable fasteners, such as bolts 420, 422 are received through the shunt apertures 400, 402, and the core apertures 410, 412. Bolts 420, 422 are held in place by respective nuts 430 and 432. With regard to bolt 422, a spacing assembly 440 may be disposed between the outer surface 214 of the core 142 and the nut 432. The spacing assembly 440 may include any combination of a spacer 450, a flat washer 452, and a star washer 454. In particular, the spacer 450 may be made in the form of a rubber o-ring or any other material that forms an at least water resistant seal about the core aperture 412 when compressed by the washers 452, 454. It should also be appreciated that the flat washer 452, and the star washer 454, may be replaced with any desired washer. With regard to bolt 420, a washer 460 may be disposed between the outer surface 214 of the core 142 and the nut 330. As such, the portion of the bolts 420 and 422 that extends through the core apertures 410 and 412 forms connection terminals 470 and 472, as shown in FIGS. 4 and 5. Thus, to attach the tuning section 380 to the core 142, the connection terminals 470 and 472 are received by the horizontally oriented apertures (not shown) maintained by the end 382 of the tuning section 380. Suitable fasteners, such as nuts 490 and 492 are disposed upon the connection terminals 470, 472 to hold the tuning section 380 in place. It should also be appreciated that the length dimension of the bolts 420, 422 are selected so that the connection terminals 470, 472 have a sufficient length to be received by the horizontally oriented apertures of the tuning section 380. Thus, through the connection described, the tuning section 380 is electrically coupled to the winding 153 of the coil 140 via connection terminals 470, 472 and the shunt 170.

In addition, tuning circuit 100 also includes a pair of rods 500, 502 that are adjustably and electrically coupled to tuning section 380 via an adjustable fastener 510 that is received by the aperture (not shown) maintained at end 384 of tuning section 380. Thus, it should be appreciated that an electrical current is able to pass through the rods 500, 502, the tuning section 380, the coil 140, the compensation section 110 and the trap 102 during operation of the tuning circuit 100. Additionally, fastener 510 may comprise a bolt, washer and nut assembly configured to be received within the aperture maintained by end 384 of tuning section 380, such that the washer applies a suitable force against rods 500, 502 to retain their position. Thus, such a configuration allows the length of rods 500, 502 to be selectively adjusted, so as to achieve the desired tuning characteristics for tuning circuit 100. It should also be appreciated that rods 500, 502 are formed from electrically-conductive material, such as copper, steel, aluminum, or any other like material.

Thus, tuning circuit 100 provides a series LC (inductance/capacitance) resonant circuit from which coil 140 provides a predetermined level of inductive reactance, and the length of rods 500, 502 provides a predetermined level of capacitive reactance, so as to establish a desired resonant frequency. In other words, the capacitance (C) and inductance (L) values for respective rods 500, 502 and coil 140 may be determined experimentally or by as the result of the use of known formulas, whereby the values of the inductive reactance provided by the coil 140 effectively cancels the capacitive reactance of the rods 500, 502, so as to define a desired resonance frequency or operating frequency for the tuning circuit 100. However, when used with operating frequencies above the resonance frequency of the tuning circuit 100, the amount of inductive reactance increases at the coil 140, with respect to the amount of capacitive reactance at the rods 500, 502. As such, the tuning circuit 100 will introduce a net amount of inductive reactance to the trap antenna 104 to which it is attached. Conversely, when used with operating frequencies below the resonance frequency of the tuning circuit 100, the amount of capacitive reactance increases at the rods 500, 502, with respect to the amount of inductive reactance at the coil 140. As such, the tuning circuit 100 will introduce a net amount of capacitive reactance to the trap antenna 104. Thus, the addition of a net amount of capacitive or inductive reactance to the trap antenna 104 will result in the detuning of the resonant frequency of the particular trap 102 to which the tuning circuit 100 is attached. As such, to counter the effects of this detuning, the compensation section 110 is utilized to provide additional reactance at the point to which the tuning circuit 100 is attached to the trap antenna 104, so as to cancel out the effects of the residual reactance created by the tuning circuit 100 at the resonant frequency of the trap 102.

For example, the tuning circuit 100 may be tuned to resonate at 18 MHz, and is then attached to the trap 102 that is configured to resonate at 28 MHz. As a result of the connection of the tuning circuit 100 to the trap 102, the additional inductance exhibited by the tuning circuit 100 causes the resonant frequency of the trap 102 to be reduced. To counteract this added inductive reactance provided by the tuning circuit 100, the compensation section 110 is configured so that the area of surfaces 130, 132 provides the amount of capacitance (C) needed to create the capacitive reactance to cancel, or nearly cancel, the added inductive reactance of the tuning circuit 100. As a result, the selection of the correct area for the surfaces 130, 132 of the compensation section 110 restores the previous resonant frequency of the trap 102. Moreover, since the compensation section 110 is not part of the tuning section 380, it does not affect the new resonant frequency established by the tuning circuit 100. That is, the compensation section 110 can be adjusted as needed to establish the needed level of capacitive reactance to counter the effects of the additional inductive reactance due to the attachment of the tuning circuit 100 to the trap antenna 104. Therefore, the tuning circuit 100 is able to operate at a given resonant frequency, without disturbing the resonant frequencies of the trap antenna 104.

It should also be appreciated that the attachment of the tuning circuit 100 to the trap 102 affects the operating frequency of other traps (not shown) that are maintained by the antenna 104. This is due to the fact that an amount of capacitive reactance is imparted to the antenna 104 by the tuning circuit 100, when the antenna 104 is used at frequencies above the operating frequency of the tuning circuit 100. For example, if the trap positioned above the 28 MHz trap 102 is configured to operate at 21 MHz, the additional capacitive reactance added to the antenna 104 by the 18 MHz tuning circuit 100 is nullified, or at least partially nullified by an amount of inductive reactance, established by lengthening, or otherwise adjusting the distance between the trap 102 and the adjacent trap tuned to 21 MHz. It is also submitted that the added inductive reactance imparted by adjusting the distance between adjacent, or subsequent traps may be utilized with traps and a tuning circuit that operate at frequencies other than those discussed herein.

To configure tuning circuit 100 for operation at a desired resonant frequency, the user selects the inductance (L) and capacitance (C) maintained by coil 140 and rods 500, 502, respectively. To adjust the inductance (L) of coil 140, the user may increase or decrease the number of windings 153, for example, although other methods may be utilized. Similarly, to adjust the capacitance (C) of rods 500, 502, the length of rods 500, 502 may be lengthened or shortened by adjusting them via fastener 510 as previously discussed. To compensate for the additional inductive reactance that is added to trap 102 due to the tuning circuit 100, the area of surfaces 130, 132 of compensation section 110 are selected so that a suitable amount of capacitive reactance is produced. Thus, once tuning circuit 100 is configured as discussed, it may then be attached to trap 102.

Tuning circuit 100 may be mounted to a trap 102 that is tuned to receive and transmit signals having a frequency of 28 MHz for example. To obtain another operating frequency, the user may adjust rods 500, 502 and coil 140 so as to configure tuning circuit 100 to transmit and receive signals having a frequency of 18 MHz, for example. Because, the addition of tuning circuit 100 alters the resonant frequency of the 28 MHz trap 102, the user configures the compensation section 110 in the manner previously discussed, to provide a suitable amount of capacitive reactance to restore the 28 MHz operating frequency to trap 102. It should be appreciated that the examples presented above are for illustration purposes only, and should not be construed as limiting as the tuning circuit 100 may be tuned to any desired resonant frequency and used with traps tuned to any resonant frequency as well.

It will, therefore, be appreciated that one advantage of one or more embodiments of the present invention is that a tuning circuit may be attached to a trap maintained by a trap antenna so as to add additional resonant frequencies thereto, without affecting the resonant frequency of the trap and the antenna to which the tuning circuit is attached. Yet another advantage of the present invention is that the tuning circuit may include a compensation section configured to restore the resonant frequency of the trap to which the tuning circuit is attached. Still another advantage of the present invention is that the tuning circuit comprises a series inductance/capacitance (LC) circuit that may be adjusted so that the tuning circuit can achieve a desired resonant frequency.

What is claimed is:

1. A tuning circuit for a trap antenna having at least one trap with an electrically-conductive surface, the tuning circuit comprising an electrically-conductive coil having a first end and a second end; an electrically-conductive compensation section coupled to said first end of said coil, said compensation section adapted to be electrically coupled to the conductive surface of the trap; and a pair of electrically-conductive rods electrically connected to said second end of said coil.

2. The tuning circuit of claim 1, wherein said coil is disposed about a core.

3. The tuning circuit of claim 2, wherein said compensation section is attached to said core.

4. The tuning circuit of claim 1, wherein said compensation section has opposing ends.

5. The tuning circuit of claim 4, wherein said compensation section has a rectangular cross-section.

6. The tuning circuit of claim 1 further comprising an electrically-conductive tuning section coupled to said second end of said coil, said rods being connected to said tuning section and extending in opposite directions from said tuning section.

7. The tuning circuit of claim 6, wherein said coil is disposed about a core and said tuning section is attached to said core.

8. The tuning circuit of claim 6, wherein said tuning section is shorter in length than said compensation section.

9. The tuning circuit of claim 6, wherein said tuning section has opposing ends.

10. The tuning circuit of claim 9, wherein said tuning section has a rectangular cross-section.

11. The tuning circuit of claim 6, wherein said rods are adjustably coupled to said tuning section to adjust their length.

12. A method for tuning a trap antenna having at least one trap tuned to a predetermined frequency, the trap having an electrically-conductive surface, comprising the steps of providing a tuning circuit having an electrically-conductive coil coupled at one end to an electrically-conductive compensation section and at another end, to a pair of electrically-conductive rods; attaching the compensation section to the at least one trap; adjusting the coil and the rods to tune the tuning circuit to a desired resonant frequency; and adjusting the dimension of said compensation section to establish an amount of capacitive reactance that substantially equals the amount of inductive reactance of the coil if the resonant frequency of the tuning circuit is below the predetermined frequency of the trap to thereby enable the trap antenna to be operable at the predetermined frequency and the desired resonant frequency.

13. The method of claim 12, wherein there are at least two traps tuned to predetermined frequencies, and further comprising the step of adjusting the distance between the at least two traps to establish an amount of inductive reactance that substantially equals the amount of capacitive reactance of the tuning circuit, if the antenna is operated at a frequency above the desired frequency of said tuning circuit, to thereby enable the trap antenna to be operable at the predetermined frequencies and the desired resonant frequency.

14. The method of claim 12, wherein the coil is disposed about a core and further comprising the step of attaching one end of the compensation section and the tuning section to the core.

* * * * *